US005080697A

United States Patent [19]

Finke

[11] Patent Number: 5,080,697

[45] Date of Patent: Jan. 14, 1992

[54] DRAW-DOWN CYCLONIC VACUUM CLEANER

[75] Inventor: Eugene W. Finke, Wilmington, Ohio

[73] Assignee: Nutone, Inc., Cincinnati, Ohio

[21] Appl. No.: 504,134

[22] Filed: Apr. 3, 1990

[51] Int. Cl.[5] ..... A47L 9/10; B01D 45/12

[52] U.S. Cl. ..... 55/97; 15/353; 55/337; 55/459.1; 55/472; 55/DIG. 3

[58] Field of Search ..... 55/97, 337, 459.1, DIG. 3, 55/429, 439, 467, 472; 15/347, 353

[56] References Cited

U.S. PATENT DOCUMENTS

| | | | |
|---|---|---|---|
| 739,263 | 9/1903 | Kenney | 55/439 |
| 1,170,438 | 2/1916 | Fahrney | 55/337 |
| 2,943,698 | 7/1960 | Bishop | 55/337 |
| 3,013,628 | 12/1961 | Jacobs et al. | 422/173 |
| 3,320,727 | 5/1967 | Farley et al. | 55/337 |
| 3,543,325 | 12/1970 | Hamrick | 15/314 |
| 4,198,726 | 4/1980 | Powell, Jr. | 55/337 |
| 4,268,288 | 5/1981 | Coombs | 55/337 |
| 4,269,607 | 5/1981 | Walker | 55/337 |
| 4,731,101 | 3/1988 | Kanda | 55/337 |
| 4,950,317 | 8/1990 | Dottermans | 55/337 |

FOREIGN PATENT DOCUMENTS

| | | | |
|---|---|---|---|
| 52-59371 | 5/1977 | Japan | 55/337 |

*Primary Examiner*—Jay H. Woo
*Assistant Examiner*—James P. Mackey
*Attorney, Agent, or Firm*—Wood Herron & Evans

[57] ABSTRACT

A vacuum cleaning apparatus is provided having a canister, a motor mounted to the exterior of the canister, a cyclonic cone centrally disposed within said canister, an inlet port in the canister wall opposing the cyclonic cone, an outlet port above the cyclonic cone and a primary filter within the canister between the lower end of the cyclonic cone and the canister bottom wall. When the motor pulls air from the canister through the outlet port, dirt laden air entering the inlet port passes the cyclonic cone and downwardly spirals around the cyclonic cone and passes through the primary filter. The filtered air is then pulled upwardly through the interior of the cyclonic cone and exits through the outlet port. A secondary filter can be interposed between the outlet port and the primary filter for additional air filtration.

12 Claims, 2 Drawing Sheets

DRAW-DOWN CYCLONIC VACUUM CLEANER

FIELD OF THE INVENTION

This invention relates to vacuum cleaners and more specifically, to cyclonic vacuum cleaners.

BACKGROUND

Vacuum cleaners can be grouped into two basic categories. Vacuum cleaners in the first category use a bag for the filtration and retention of particulate matter. The vacuum cleaners in the second category are bagless and utilize cyclonic separation to remove particulate matter from the vacuum airflow.

One example of a cyclonic vacuum cleaner is the apparatus disclosed in U.S. Pat. No. 739,263. That device has a cylindrical body which is separated by a dividing flange into an upper portion and a lower portion. The upper portion of the cylinder has an outlet port extending through the cylinder wall and the lower portion has an inlet port extending through the cylinder wall. Attached to the dividing flange is a baffle which has a cylindrical hollow body that tapers to a smaller opening at its lower end. The inlet port is placed in the cylinder wall so that air flowing into the cylinder strikes the baffle tangentially.

In operation, air flowing into the cylinder through the inlet port swirls around the baffle and downwardly below the opening in the baffle. The dirt suspended in the air then falls to the bottom of the cylinder and the clean air rises through the baffle interior and into the upper portion of the cylinder. The air then flows through the outlet port towards an externally located pump. An opening is provided in the bottom wall of the cylinder through which the collected dirt is removed.

A vacuum cleaner of the foregoing construction possesses several limitations. First, these vacuum cleaners rely upon gravity alone to remove dirt from the air. If the particles in the air flow are small enough the energy imparted to them from the moving air flow is sufficient to overcome the gravitational pull against the particles and they will remain in the air flow. To overcome this limitation devices incorporating secondary filters which filter the rising air within a cyclonic vacuum cleaner have been built. Devices which utilize such secondary filters are shown in U.S. Pat. Nos. 3,320,727; 3,543,325 and 1,170,438.

The use of secondary filters within such devices have caused additional problems. In devices such as that shown in U.S. Pat. No. 3,543,325, removal of the collected dirt can be quite messy. When the portion of the vacuum cleaner which contains the secondary filter is separated from the body of the vacuum cleaner, the dirt resting against the secondary filter is disturbed during this procedure. This dirt is then dispersed in the immediate vicinity, which is usually in the operator's face. This problem arises because the filtered dirt and the dirt removed by the gravitational pull are collected in two different locations within the vacuum cleaner. This problem is also apparent in U.S. Pat. No. 3,320,727 where a bag filter is used in conjunction with the cyclonic separation method.

Another limitation of some of the known cyclonic vacuum cleaners is the requirement that a second receptacle is necessary to remove the accumulated dirt through the lower opening as shown in U.S. Pat. No. 739,263. A method for eliminating the need for this second receptacle is demonstrated in U.S. Pat. Nos. 3,320,727; 3,543,325 and 1,170,488. All of these patents describe devices which use a receptacle that lies entirely below the cyclonic baffle. These designs still suffer from the limitation that the filtered dirt is not stored in the same receptacle as the dirt separated by the cyclonic separation.

SUMMARY OF THE INVENTION

The present invention provides an apparatus which combines the cyclonic separation method and the filtration method for removing particles from an air flow. The apparatus collects the dirt removed by both cleaning methods in a single receptacle to facilitate the emptying of the receptacle.

In a preferred embodiment, a canister is provided having a cylindrical shape. The canister has a side wall, a top wall and a bottom wall. A motor is attached to the top wall exterior to create negative air pressure within the canister. A first opening in the side wall of the canister is provided so air can be drawn into the canister. Opposite the first opening in the canister side wall a structure, preferably conical in shape, is provided. Air entering the canister through the first opening flows past the conical structure tangentially and begins to move in a downwardly spiralling motion around the conical structure. A filter is placed at the lower end of the conical structure, on or just above the canister bottom wall, and the downwardly spiralling air flow passes through the filter. Any dirt particles within the downwardly spiralling air flow are removed by the filter and remain atop the filter. Preferably, the conical structure will be hollow and the lower end of the conical structure will extend at least to the filter. The filtered air will flow between the filter and the canister bottom wall and rise through an opening in the lower end of the conical structure, up through the conical structure interior, towards the top wall of the canister. A second filter and opening are preferably provided in the top wall of the canister through which the rising air will exit the canister, thus further filtering the air to ensure a relatively dirt-free exhaust air stream.

The invention provides an apparatus which produces a downwardly spiralling air flow of the dirt-laden air that is drawn into a cylindrical canister; the downwardly spiralling air flow is then filtered to remove the dirt from the air flow. Thus the apparatus utilizes both the cyclonic/gravity separation air cleaning method and the filtration air cleaning method for cleaning the dirt-laden air drawn into the canister.

This apparatus has the advantage of collecting dirt separated by both methods in the same receptacle. Combining these two methods provides the further advantage that the dirt collected in the canister atop the filter acts as an additional porous filter. Both the downwardly spiralling air flow which passes through the accumulated dirt and the weight of the accumulated dirt itself cause compaction of the accumulated dirt, especially in the lower levels thereof adjacent the filter. This compacted dirt, which has relatively small spaces between dirt particles, provides a superior filtering effect over that of loosely packed dirt.

This compaction resulting from the downwardly spiralling air flow pressing against the accumulated dirt also improves the capacity of the vacuum cleaner since the compacted particulate is denser than that collected by cyclonic vacuum cleaners utilizing gravitational pull alone. As this dense accumulation of dirt increases within the canister the flow of air from the the canister inlet to the canister outlet will be substantially decreased. When this occurs, the operator will notice a corresponding decrease in the suction power of the vacuum cleaner and be alerted that the canister needs to be emptied. Thus, the vacuum cleaner of the present invention provides the operator with a simple, expedient means for recognizing that the canister needs to be emptied without requiring any additional circuitry or structures.

These and other objects and advantages of the present invention shall be made apparent from the accompanying drawings and the description thereof.

BRIEF DESCRIPTION OF THE DRAWINGS

The accompanying drawings, which are incorporated and constitute a part of this specification, illustrate a preferred embodiment and an alternative embodiment of the invention and, together with the general description given above, and the detailed description of the embodiment given below, serve to explain the principles of the invention.

FIG. 1A is an enlarged cross-section of the encircled portion of FIG. 1.

DETAILED DESCRIPTION OF THE INVENTION

Figure 1:
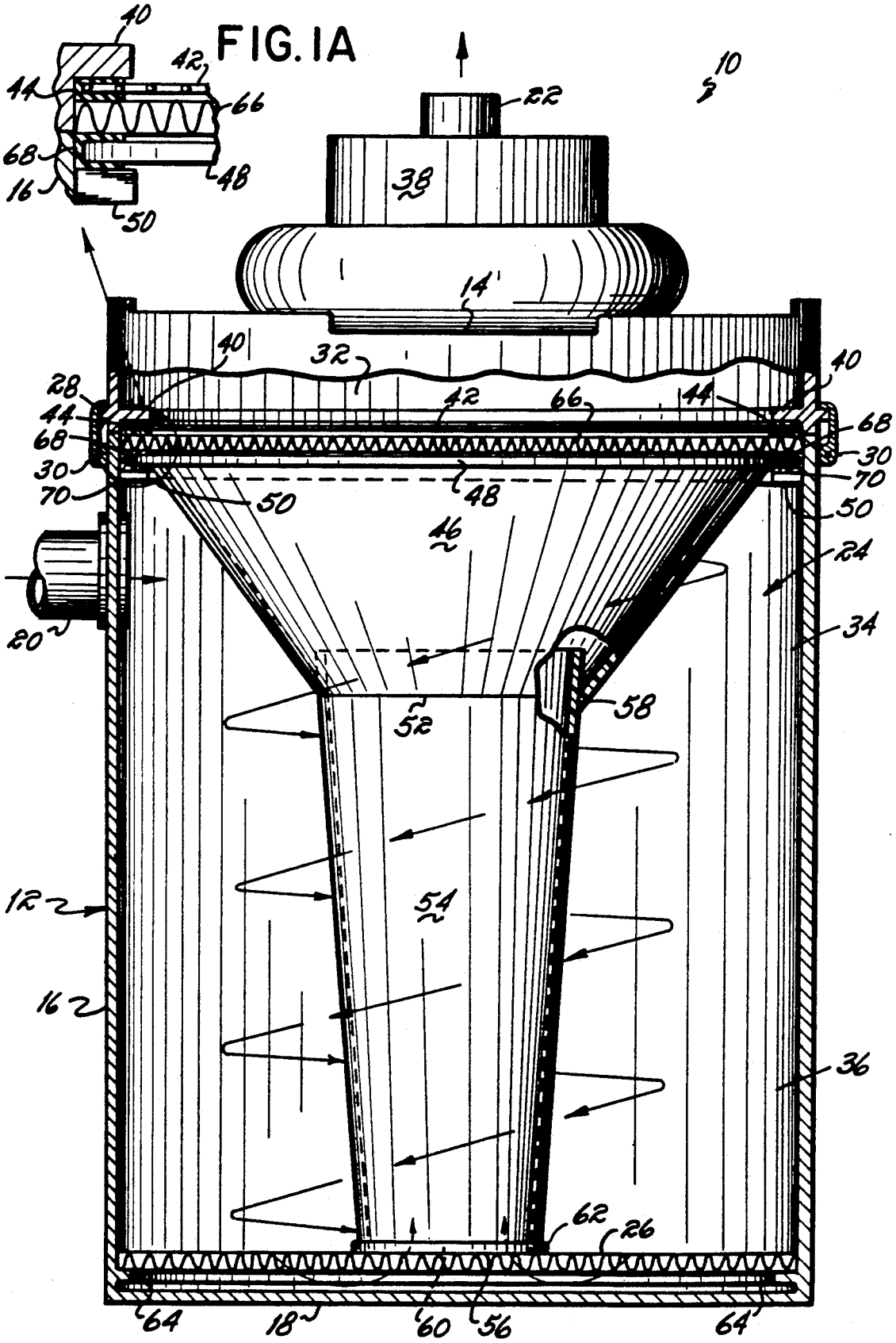
FIG. 1 is a side elevational view, in vertical cross section, of a preferred embodiment of the vacuum cleaning apparatus of the present invention.

In a vertical cross section of the preferred embodiment shown in FIG. 1 the apparatus 10 has a cylindrical canister 12. The canister 12 has a top wall 14, a side wall 16 and a bottom wall 18. The canister has an inlet port 20 and an outlet port 22. The placement of the inlet port 20 and the outlet port 22 is discussed in detail below. Centrally located within the canister 12 is a cyclonic cone 24, which preferably comprises upper cone 46 and lower cone 54. At the lower end of the cyclonic cone 24 a horizontally disposed primary filter 26 is provided.

The canister 12 in FIG. 1 is preferably a cylindrical canister, although other structural shapes are possible. The canister which is preferably sized to contain 10 to 12 gallons of dirt has three sections. The first is upper section 32, which is removable from the remainder of the canister to provide access to the canister interior. The second and third sections, intermediate section 34 and lower section 36, respectively, correspond generally to the sections of the canister in which upper cone 46 and lower cone 54 of cyclonic cone 24 are disposed.

Looking again to FIG. 1, the elements of the invention will be explained in greater detail. A lip 28 mounted to or formed on the exterior of the upper section 32 and a latch 30 mounted to the exterior of the intermediate section 34 cooperate to hold the upper section 32 of the vacuum cleaner 10 in sealing engagement against the intermediate section 34 of the apparatus 10. The upper section 32 has a motor 38 which is centrally mounted on the exterior of the top wall 14. The motor is preferably a 1.05 hp electric motor, or other motor of a size suitable to perform the desired function, which is to pull a vacuum through the apparatus. Also included in the upper section 32 is a flange 40, the purpose of which will be explained in detail below.

The cyclonic cone 24 is comprised of two conical sections, upper cone 46 and lower cone 54, which can be a unitary structure, although preferably it is comprised of two separate parts. The upper cone 46 has a top edge 48 which has a diameter that is approximately equal to that of the inner diameter of the canister 12; in a preferred embodiment, that diameter is about 10". The lower edge 52 of the upper cone 46 has an approximate diameter of 4". Thus the upper cone 46 has a substantial taper from top edge 48 to lower edge 52.

The lower cone 54 of the cyclonic cone 24 is only slightly tapered and may be substantially cylindrical. The upper end 57 of lower cone 54 preferably has a diameter of a size such that the upper end 57 fits snugly yet slidably through opening 58 defined by lower edge 52 of upper cone 46. It will be appreciated, however, that lower cone 54 may taper to a significantly smaller diameter at its lower end 56 relative to the diameter at its upper end 57. Preferably, the lower cone 54 extends down to and lower end 56 thereof fits frictionally within upstanding rim 62 of primary filter 26.

Figure 2:
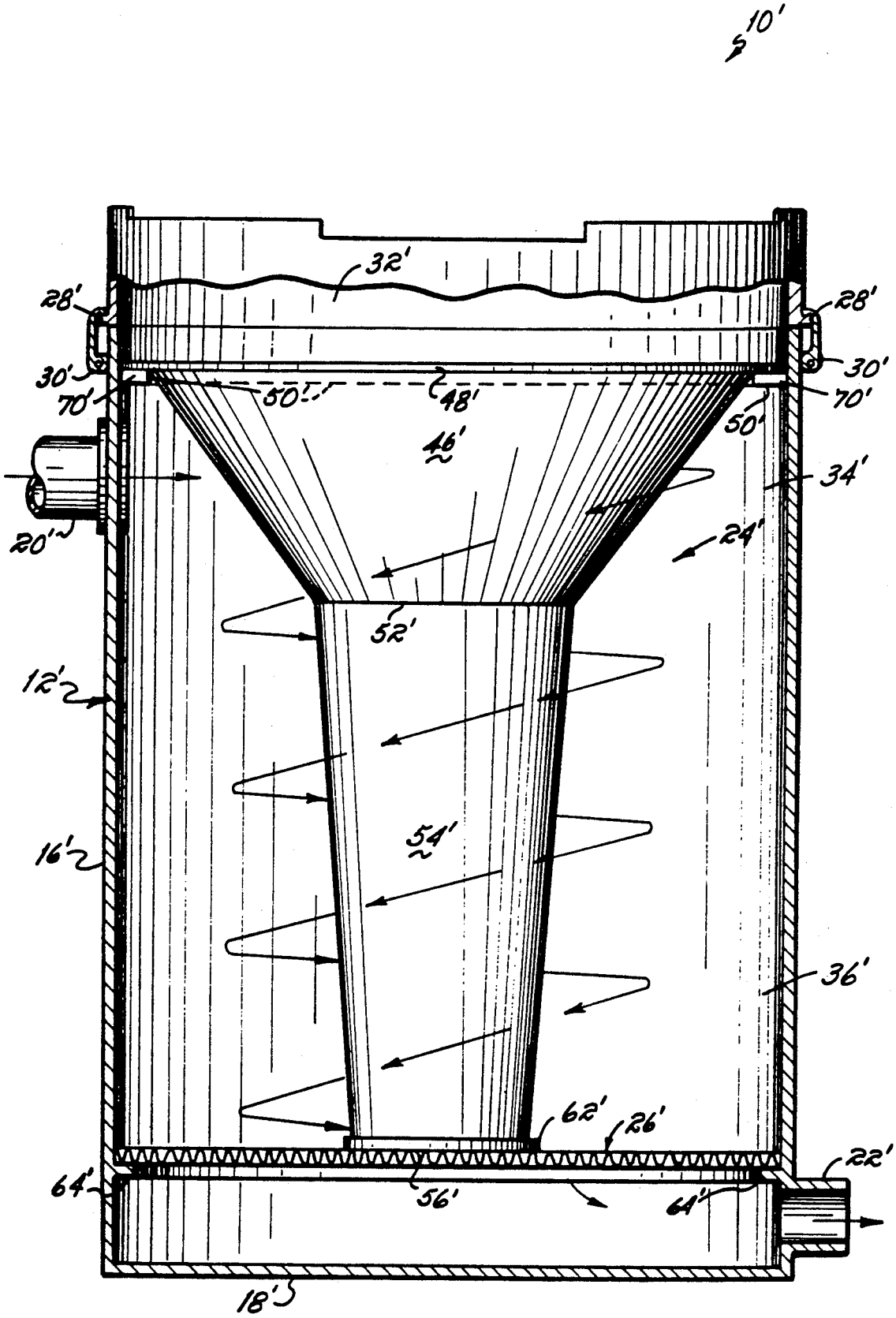
FIG. 2 is a side elevational view, in vertical cross section, of an alternative embodiment of the vacuum cleaning apparatus of the present invention.

In the preferred embodiment shown in FIG. 1, both the upper cone 46 and the lower cone 54 are hollow, while in the alternative embodiment shown in FIG. 2 they may be solid or hollow. Additionally, in the preferred embodiment shown in FIG. 1, lower edge 56 of the lower cone 54 defines opening 60, upper end 57 of lower cone 54 has an opening 63 therein, and top edge 48 of the upper cone 46 defines opening 59. With this configuration, a continuous air flow path is provided from inlet port 20, down through primary filter 26, up through the interior of cyclonic cone 24 via openings 60, 63 and 59, through secondary filter 66 and out through outlet port 22.

The diameter of the primary filter 26, shown in FIG. 1, is approximately equal to the inner diameter of the canister 12. The primary filter 26 is a fiberglass fiber-type filter which has fiber spacings on the order of 0.025 to 0.031 inches. Although primary filter 26 preferably rests atop flange 64 extending inwardly from side wall 16 of the canister 12 slightly above bottom wall 18, the filter 26 alternatively could rest atop and in direct contact with the bottom wall 18. A flange 50 extends inwardly from the side wall 16 within the intermediate section 34 and supports the top edge 48 of the upper cone 46. Two diametrically opposed slots 70 are provided in the flange 50 for the removal of the primary filter 26, as will be described below.

Upper cone 46 has an annular U-shaped rubber seal 68 which encloses the outside circumference of top edge 48 and frictionally fits against the side wall 16 of the intermediate section 34. A secondary filter 66 is placed atop the top edge 48 of upper cone 46. Within the upper section 32, a perforated disk 42 having an annular U-shaped rubber seal 44 around its perimeter frictionally fits against the side wall 16 beneath the flange 40. Preferably, the perforated disk has square holes having sides of 0.20" formed by strands of 22 gauge galvanized steel wire.

When the upper section 32 is placed atop the intermediate section 34 the side wall portions of the respective sections will mate. The latch 30 and the lip 28 then cooperate to secure the two sections to one another. When this occurs the flange 40 urges the U-shaped rubber seal 44 of the perforated disk 42 against the secondary filter 66 supported by both the U-shaped rubber seal 68 surrounding the top edge 48 and the flange 50. Under this pressure the U-shaped rubber seals 44 and 68 flatten and the perforated disk 42 contacts or almost contacts the secondary filter 66. In this position, the perforated disk 42 supports the secondary filter 66 against the flow of air rising within the cyclonic cone 24 and prevents the secondary filter 66 from bending too far and rupturing. An expanded view of this structure is provided in FIG. 1A for clarification.

As shown in FIG. 1, the inlet port 20 with an approximate diameter of 1.75" is preferably placed in the side wall 16 below the flange 50 and above the lower cone 54 of the cyclonic cone 24. The inlet 20 preferably should be placed within the intermediate section 34 of the canister 12 so that air entering the canister 12 through the inlet 20 tangentially passes the cyclonic cone 24 off center. The outlet port 22 is preferably placed in the top wall 14, although it is not limited to such a placement. The outlet 22 could also be placed in the side wall 16 above the top edge 48 of the cyclonic cone 24 or, as in the alternative embodiment, below the primary filter 26. Additionally, the outlet port 22 could be placed in the bottom wall 18.

An alternative embodiment of the present invention is depicted in FIG. 2. Vacuum cleaner 10' operates in substantially the same manner as vacuum cleaner 10 shown in FIG. 1 in that it utilizes both cyclonic and filtration separation to clean dirt laden air. The vacuum cleaner 10' has a canister 12' with a top wall 14', a side wall 16' and a bottom wall 18'. A cyclonic cone 24' having an upper cone 46' and lower cone 54' is centrally and vertically disposed within the canister 12'. The top section 32' of the canister 12' is detachable from the intermediate section 34' and lower section 36' of the canister 12'. The upper section 32' is held against the intermediate section 34' during operation of the apparatus by a lip 28' attached to the upper section 32' cooperating with a latch 30' which is attached to the intermediate section 34'.

An inlet port 20' in FIG. 2 is placed in the side wall 16' of the intermediate section 34' so air entering canister 12' through inlet port 20' will tangentially pass the upper cone 46'. A primary filter 26' is horizontally disposed within the canister 12'. A rim 62' attached to the primary filter 26' frictionally fits the lower end 56' of the lower cone 54'. The flange 64' against which the primary filter 26' rests is set at least 2" above the bottom wall 18'. An outlet port 22' is horizontally disposed within the side wall 16' below the flange 64'. Although not shown, a secondary filter could be disposed adjacent outlet port 22' to further filter the air exiting the canister. A motor (not shown) is operatively connected to the outlet port 22' to create a subatmospheric air pressure within the canister 12'.

In operation of the preferred embodiment of FIG. 1, the upper section 32 is secured to the intermediate section 34 by the lip 28 and the latch 30. In this secured position, the perforated disk 42 supports the secondary filter 66 to prevent filter rupture. A vacuum motor 38 pulls air out of the canister through the outlet port 22 to reduce the air pressure within the canister 12 below the air pressure exterior of the canister. The air outside of the canister will then enter the canister through the inlet port 20 and tangentially strike the cyclonic cone 24 at the upper cone 46. The air follows the contours of the cyclonic cone and takes on a downwardly spiralling air flow path. This air flow will strike the primary filter 26 before encountering the bottom wall 18. As the air flow passes through the primary filter 26 much of the particulate or dirt in the air flow will be removed by the primary filter 26. Due to the action of vacuum motor 38, and after passing through primary filter 26, the filtered air below the primary filter 26 will be drawn through the opening 56 in the lower cone 54 of the cyclonic cone 24. This air will rise through the cyclonic cone 24 and pass through the secondary filter 66 and the perforated disk 42. The twice filtered air will then be exhausted from the canister 12 via the outlet port 22.

In the alternative embodiment of FIG. 2, the upper section 32' is secured to the intermediate section 34' by the lip 28' and the latch 30'. The canister 12' is now able to maintain a subatmospheric pressure when the motor (not shown) is operating. The motor (not shown) pulls air from the canister 12' via the outlet port 22' located in the lower section 36' of the canister, creating the subatmospheric pressure within the canister 12'. Air exterior of the canister will then enter the canister 12' via the inlet port 20', tangentially strike the cyclonic cone 24' and downwardly swirl around the cyclonic cone 24'. The downwardly spiralling air will pass through the primary filter 26' which removes particulate from the air. The filtered air will then exhaust the canister 12' through the outlet 22'.

Three significant advantages of the present invention become apparent as the dirt and particulate accumulate against the primary filter 26 (FIG. 1) or 26' (FIG. 2). First, the layer of dirt and particulate held against the primary filter 26 or 26' by the downward air flow will act as an additional filter for the downwardly spiralling air flow. This additional filtering produces a cleaner exhaust from the vacuum cleaner which protects the motor connected to the outlet port 22 or 22'. Second, the downwardly spiraling air flow will compact the dirt accumulated against the primary filter 26 or 26'. This compaction will increase the dirt capacity of the canister since the dirt is more densely packed than the dirt accumulated by gravitational pull alone. This compaction of dirt also improves the filtering of the air flow performed by the accumulated dirt since the spaces between the dirt particles are reduced by the compaction. Third, as more dirt is collected and as the dirt is compacted, the flow of air through the dirt and the primary filter 26 or 26' is reduced. When the canister is nearly full the air flow will be reduced to a point where the operator will notice an appreciable drop in the suction power of the vacuum cleaner. This drop in suction power informs the operator that the canister is ready to be emptied. Thus, the apparatus of this invention indicates a full condition to the operator without any additional circuitry or switches.

To empty the apparatus shown in FIG. 1, the operator disengages the latch 30 from the lip 28 and lifts the upper section 32 from the intermediate section 34. The secondary filter 66 is then lifted from the top edge 48 of the upper cone 46 for cleaning. The lower cone 52 is then pulled through the opening 58 in the upper cone 46 and removed from the canister 12. The upper cone 46 is then lifted from the canister 12 by its top edge 48. The canister 12 is then emptied by pouring the accumulated dirt packed against the primary filter 26 into a refuse receptacle. The primary filter 26 is removed for cleaning by tilting the filter into a vertical orientation and pulling the primary filter 26 through the notches 70 in the flange 50.

The apparatus of the alternative embodiment shown in FIG. 2 is cleaned by disengaging the latch 30' from the lip 28' and removing the upper section 32'. The solid cyclonic cone 24' is then removed by lifting the top edge 48' and the accumulated dirt can then be poured from the canister 12'. The primary filter 26' is then vertically tilted and pulled through the notches 70' in the flange 50' after the filter is vertically oriented.

While the present invention has been illustrated by the description of the preferred and alternative embodiments and while the embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific detail, representative apparatus and method, and illustrative examples shown and described. Accordingly, departures may be made from such details without departing from the scope or spirit of applicant's general inventive concept.

What is claimed is:

1. A vacuum cleaning apparatus comprising:

a receptacle having a side wall, a top wall and a bottom wall to define a volume therebetween;

a first opening in said side wall;

a second opening in said top wall;

means for producing a downwardly spiralling air flow from air entering said receptacle through said first opening, said downwardly spiralling air flow producing means having an imperforate exterior surface, an interior, an upper section, and a lower section, said lower section having an opening therein so that said interior communicates with a portion of said volume outside said imperforate exterior surface, said downwardly spiralling air flow producing means being positioned so that said upper section is opposed to said first opening in said side wall and separates said first opening from said second opening in said top wall, said opening in said lower section of said air flow producing means being proximate said bottom wall of said receptacle;

a filter positioned within said portion of said volume outside said air flow producing means so that said filter is interposed between said first opening in said side wall and said opening in said lower section, said filter substantially spanning said portion of said volume from said side wall to said air flow producing means; and vacuum producing means operatively connected to said second opening to create subatmospheric air pressure in said volume within said receptacle which pulls air into said receptacle through said first opening, said air tangentially striking and downardly spiralling around said imperforate exterior surface of said downwardly spiralling air flow producing means, passing through said filter, entering said opening in said lower section of said air flow producing means and rising through said interior towards said second opening in said top wall, and exhausting said receptacle through said second opening whereby particulate in said air entering through said first opening is removed by said filter and the removed particulate is compacted atop said filter by said air flow downwardly spiralling about said imperforate exterior surface of said air flow producing means.

2. A vacuum cleaning apparatus according to claim 1 wherein said imperforate exterior surface of said downwardly spiralling air flow producing means has a substantially conical shape.

3. A vacuum cleaning apparatus according to claim 2 further comprising:

a second filter positioned between said second opening in said top wall and said opening in said lower section, said second filter substantially spanning said interior of said air flow producing means whereby the filtered air rising through said interior is filtered a second time before exhausting the receptacle through said second opening.

4. The vacuum cleaning apparatus of claim 1 wherein said top wall is selectively removable from said side wall of said receptacle to expose said interior of said downwardly spiralling air flow producing means whereby said downwardly spiralling air flow producing means is removable from said receptacle without disturbing the compacted particulate so that the compacted particulate may be emptied from the receptacle.

5. A vacuum cleaning apparatus comprising:

a receptacle having a side wall, a top wall and a bottom wall to define a volume therebetween;

a first opening in said side wall;

a second opening in said top wall;

means for producing a downwardly spiralling air flow from air entering said receptacle through said first opening, said downwardly spiralling air flow producing means having an imperforate exterior surface, an interior, an upper section, and a lower section, said lower section having an opening therein so that said interior communicates with a portion of said volume outside said imperforate exterior surface, said air flow producing means being positioned so that said upper section is opposed to said first opening in said side wall and separates said first opening from said second opening, said opening in said lower section being proximate said bottom wall; and a filter positioned within said volume outside said imperforate exterior surface so that said filter is interposed between said first opening and said opening in said lower section, said filter substantially spanning said portion of said volume outside said exterior surface from said side wall to said exterior surface of said air flow producing means whereby air entering said receptacle through said first opening downwardly spirals about said air flow producing means, passes through said filter, enters said interior through said opening in said lower section and rises through said interior towards said second opening in said top wall whereby particulate in said air passing through said filter is removed by said filter and the removed particulate is compacted atop said filter by said air flow downwardly spiralling about said imperforate exterior surface of air flow producing means.

6. A vacuum cleaning apparatus according to claim 5 wherein said imperforate exterior surface of said downwardly spiralling air flow producing means has a generally conical shape with a decreasing diameter towards said opening in said lower section.

7. A vacuum cleaning apparatus according to claim 6 further comprising:

a second filter positioned between said opening in said lower section and said second opening in said top wall so that the filtered air rising through said interior of said air flow producing means is filtered a second time before exhausting the receptacle through said second opening.

8. A vacuum cleaning apparatus according to claim 5, wherein said upper section of said air flow producing means is generally funnel shaped; and said lower section of said air flow producing means is generally cylindrical, said upper section being joined to said lower section so that said interior of said air flow producing means only communicates with said portion of said volume outside said air flow producing means through said opening in said lower section.

9. The vacuum cleaning apparatus of claim 5 wherein said top wall is selectively removable from said side wall of said receptacle to expose said interior of said downwardly spiralling air flow producing means whereby said downwardly spiralling air flow producing means is removable from said receptacle without disturbing the compacted particulate so that the compacted particulate may be emptied from the receptacle.

10. A method of vacuum cleaning dirt laden air comprising the steps of:

sucking dirt laden air into a receptacle having top, bottom and side walls to define a volume through a first opening in said side wall of said receptacle;

directing said dirt laden air tangentially against a vertically disposed conical imperforate structure having an exterior, an interior, and an open lower end to create a downwardly directed flow of said dirt laden air;

passing said downwardly directed flow of said dirt laden air through a first filter which spans said volume between said side wall and said exterior of said conical structure, said first filter located within said volume between said first opening and said open lower end of said conical structure;

passing said air after it passes through said first filter through said open lower end of said conical structure and upwardly through said interior of said vertically disposed conical structure; and exhausting the air that passes upwardly through said interior of said conical structure from said receptacle through a second opening in said receptacle.

11. The method of vacuum cleaning dirt laden air according to claim 10 further comprising the step of:

passing said air that passes upwardly through said conical structure through a second filter located between the second opening and the open lower end of the conical structure.

12. The method of claim 10 wherein said downwardly directed flow of said dirt laden air compacts particulate removed from the dirt laden air by said first filter atop said first filter.

* * * * *